US005545058A

United States Patent [19]

Albrecht

[11] Patent Number: 5,545,058

[45] Date of Patent: Aug. 13, 1996

[54] SOCKET FOR SMALL INCANDESCENT LAMP

[76] Inventor: Paul Albrecht, Stauffenbergstrasse 43, 96052 Bamberg, Germany

[21] Appl. No.: 376,990

[22] Filed: Jan. 23, 1995

[30] Foreign Application Priority Data

Jan. 21, 1994 [DE] Germany ..... 44 01 487.2

[51] Int. Cl.[6] ..... H01R 13/74

[52] U.S. Cl. ..... 439/547; 439/558

[58] Field of Search ..... 439/546–549, 439/557, 558

[56] References Cited

U.S. PATENT DOCUMENTS

| | | | |
|---|---|---|---|
| 3,378,812 | 4/1968 | Fitzgerald | 439/546 |
| 3,812,450 | 5/1974 | Simovits, Jr. et al. | 439/557 |
| 3,912,355 | 10/1975 | Curado et al. | 439/546 |
| 3,989,343 | 11/1976 | Lucius et al. | 439/557 |
| 4,993,576 | 2/1991 | Byrne | 439/557 |
| 5,015,203 | 5/1991 | Furrow | 439/557 |
| 5,178,554 | 1/1993 | Siemon et al. | 439/557 |

*Primary Examiner*—Gary F. Paumen
*Attorney, Agent, or Firm*—Jordan and Hamburg

[57] ABSTRACT

A socket for a small incandescent lamp for the detachable and fixable insertion in an opening of a printed circuit board, which is adapted to the socket and provided with enlargements at the edge, and for contacting the lamp by pressing the lamp-connection wires, which are carried at flexible contact arms, against the strip conductors of the printed circuit board, wherein the socket can be inserted with, in each case, the same orientation of the lamp, so as to make contact, into the opening from both sides of the printed circuit board and removed from both sides independently of the side from which it was inserted, and in that a first insertion mechanism, which is dependent on the insertion side, is a locking mechanism and a second insertion mechanism, which is dependent on the other insertion side, is a jamming-turning mechanism, the fixation of the socket being accomplished independently of the insertion mechanism by locking arms, which are formed flexibly at the socket, engage the printed circuit board and supported against the contact arms engaging the opposite side.

25 Claims, 4 Drawing Sheets

SOCKET FOR SMALL INCANDESCENT LAMP

BACKGROUND OF THE INVENTION

The invention relates to a socket for a small incandescent lamp for the detachable and fixable insertion in an opening of a printed circuit board which is adapted to the socket and provided with enlargements at the edge, and for contacting the lamp by pressing the lamp-connection wires, which are carried at flexible contact arms, against the strip conductors of the printed circuit board.

Different fastening mechanisms are already known for such sockets, which are to be disposed on printed circuit boards, such as a plug-in and locking mechanism, by means of which the lamps are inserted simply by snapping them into appropriate printed circuit board openings on that side, on which usually other components are also inserted; since this "snapping-in" generally is a linear movement, it can be accomplished simply by means of an automatic insertion machine. However, as a result of being fastened by a locking mechanism, the lamp can be removed only on the same side, on which it was inserted. As a result, if the lamp is defective, the whole of the printed circuit board frequently must be removed from the instrument in order to replace the lamp. In the case of a different mechanism, the lamps are inserted partially through the printed circuit board opening and fastened to the plate by a turning movement. For this reason, automatic insertion is hardly possible and the lamp must be inserted inconveniently by hand. Here also, the disadvantage exists that, in order to exchange the lamp, the printed circuit board must once again be removed if the lamp is inserted at the component side. If the lamp is mounted on the opposite side of the printed circuit board, it is usually not necessary to remove the printed circuit board. However, this type of insertion at the opposite side has the disadvantage of a very inconvenient first insertion with a separate operating step.

SUMMARY OF THE INVENTION

It is therefore the object of the invention to provide a socket for a small incandescent lamp, which is suitable for a first insertion from the component side by an automatic machine and, for the purpose of exchange, can be removed and replaced easily from the opposite side of the printed circuit board without any expensive dismantling of the instrument.

To accomplish this objective, provisions are made pursuant to the invention for a socket for a small incandescent lamp with the above-mentioned distinguishing features so that the socket can be inserted with, in each case, the same orientation of the lamp so as to make contact, into the opening from both sides of the printed circuit board, preferably from the component side and removed from both sides independently of the side from which it was inserted, and that a first insertion mechanism, which is dependent on the insertion side, is a locking mechanism and a second insertion mechanism, which is dependent on the other insertion side, is a jamming-turning mechanism, the fixation of the socket being accomplished independently of the insertion mechanism by locking arms, which are formed flexibly at the socket, engage the printed circuit board and are supported against the contact arms engaging the opposite side. This socket can thus be used to particular advantage at the component side by means of an automatic insertion machine and can therefore be integrated advantageously within the scope of an insertion line. In order to exchange it, the lamp can then simply be loosened at the opposite side of the printed circuit board by means of the twisted fixing device that is to be loosened, removed and replaced, so that the printed circuit board, inserted in the instrument, need not be removed from the latter.

So that both insertion and fastening mechanisms ensure that the socket is held securely, provisions can be made in a further development of the invention so that, to begin with, the locking arms of the locking mechanism are diametrically opposite to one another at the socket, are constructed so as to be at a distance from and running essentially congruent with the contact arms and, when the socket is inserted, snap elastically into the locked position and grip behind the edges of the opening at appropriately constricted regions. In practice, this construction means that the socket is simply snapped into the opening in an appropriate socket position, which is specified by the constricted regions, the lamp, after it is snapped in, already making complete contact and being ready to function. Pursuant to the invention, the socket has an essentially hollow cylindrical shape, the locking arms, which are provided with locking projections, being formed either by incisions in the cylinder wall or, alternatively, by legs angled by a deflection amounting essentially to 180° and running essentially parallel to the socket wall.

Furthermore, the locking arms, provided with locking projections, can be constructed pursuant to the invention as metal arms, as can the contact arms, which are constructed pursuant to the invention as metal-to-metal contact springs. The metal contact arms, as well as the metal contact springs, are mounted separately in receptacles formed in the socket and are of advantage with respect to the stability of the fastening and the spring force exerted in each case, particularly in the case of sockets of larger dimensions. If the socket is to be inserted in a printed circuit board with strip conductors on the upper side and underside of the printed circuit board, provisions can be made in a further development of the invention so that in each case one metallic locking arm and one metallic contact arm are connected together in such a manner, that strip conductors, disposed on both sides of the printed circuit board, can be contacted on the one side by the contact arm and, on the other, by the locking arm. In this connection, it has tumed out to be advantageous if the locking arm and the contact arm are constructed pursuant to the invention in one piece as a contact spring. This inventive embodiment can be used universally, advantageously, independently of the side arrangement of the printed circuit boards, since, due to the possibility of making contact on both sides, it is in any case ensured that, regardless of whether it be on the top side, the bottom side or on both sides, contacting is ensured in any case.

In order to ensure that the turning mechanism functions reliably, provisions can be made in a further development of the invention so that diametrically opposite tabs, disposed at a distance from the contact arms and offset from them, are formed at the socket in order to limit the insertion movement before the turning. After the contact arms are passed through the enlargements at the edge of the opening, said tabs engage the printed circuit board when the turning position is reached. These tabs thus make the insertion process particularly simple, since the socket simply is pushed in until it comes up against the tab at the printed circuit board and then, since it is already in the correct position, is simply tuned into the contact position. Pursuant to the invention, the angle, through which the socket is turned, is 30° to 40° and particularly 35°. In order to keep the dimensions of the socket as small as possible for this construction, so that the socket can also be used in a very narrow space, provisions can be made in a further development of the invention so that indentations, in which the tabs are disposed set towards the inside, are formed in the socket so that the tabs protrude only insignificantly over the external diameter of the cylindrical body of the socket. At the same time, provisions can be made pursuant to the invention, so that, in the contact position of the socket, the tabs run congruently with the enlargements of the opening, so that, with particular advantage, they cover these enlargements and thus reduce the passage of light through them.

In order to fix the contact position for each insertion mechanism so that a faulty, contactless insertion is avoided, a locking nose, which is constructed at the socket and, in the contact position, engages a bulge at the edge of the opening, can be provided in a further embodiment of the invention. If the socket is snapped into the opening by means of the automatic machine, the locking nose is introduced into the bulge, provided that the alignment of the socket is correct. If this is not the case, the locking nose rests on the printed circuit board and the socket cannot be snapped in, so that faulty insertion is avoided. The socket is secured by these means against inadvertent twisting. If the socket is screwed into the opening, then the contact position of the socket is indicated also here by the noticeable engagement of the locking nose in the bulge.

So that reliable contacting of the lamp-connection wires can be ensured under the varying stresses resulting from the different insertion mechanisms, provisions can furthermore be made pursuant to the invention that each laterally projecting contact arm is provided with a jamming groove, which is formed essentially at the end, accommodates the lamp-connection wire and has a diameter, which is smaller than the diameter of the lamp wire, so that so that reliable fixing of the wire to the contact arm is ensured and a loosening of the wire where it rubs against the surface of the printed circuit board, is advantageously avoided even when the socket is twisted. In addition, this contact arm can be provided with an insertion incline for fixing the correct direction of turning the lamp in the event that it is to be exchanged. In order to be able to realize the smallest possible overall height as well as the highest degree of illumination, provisions can be made in a further development of the invention to construct the region of the socket, which accommodates the incandescent lamp that is preferably disposed in a prone position, as a reflector.

Further advantages, distinguishing features and details of the invention arise out of the embodiment, described in the following as well as from the accompanying drawings.

DESCRIPTION OF THE PREFERRED EMBODIMENTS

Figure 1:
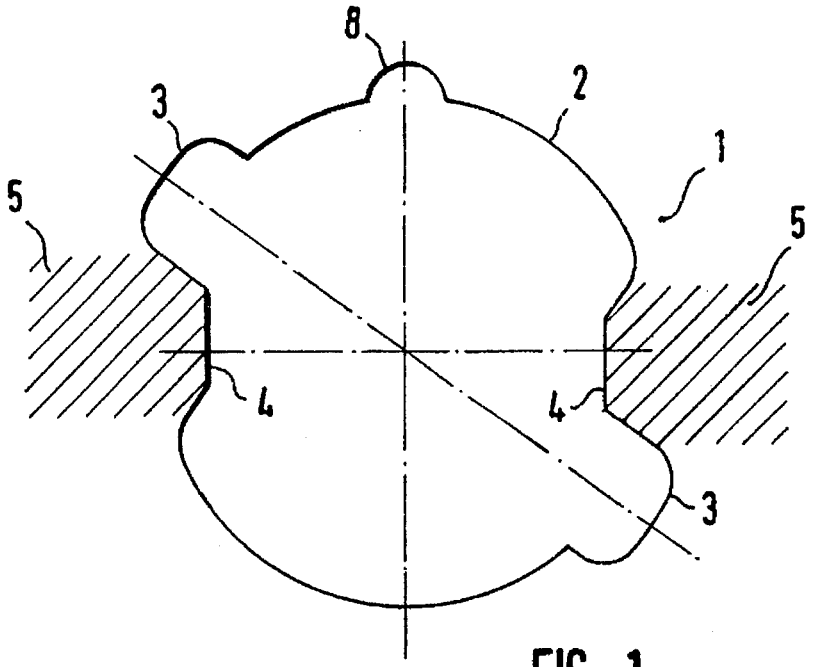
FIG. 1 shows a plan view of an opening in the printed circuit board adapted to the socket.

FIG. 1 shows an opening 2, which is essentially circular in shape, in a printed circuit board 1. The opening 2 has enlargements 3, which are diametrically opposite one another, and constricted regions 4, which are offset with respect to these enlargements and also lie diametrically opposite one anther. Adjoining these constricted regions 4 on the upper side of the printed circuit board 1 are the contact areas 5, which are engaged in the contacting position by the lamp-connection wires 6 (see FIG. 2) of a socket 7, which is to be inserted into the opening 2. Moreover, the opening 2 has a bulge 8 for accommodating a locking nose, which will be described later, and serves to fix the contact position.

Figure 2:
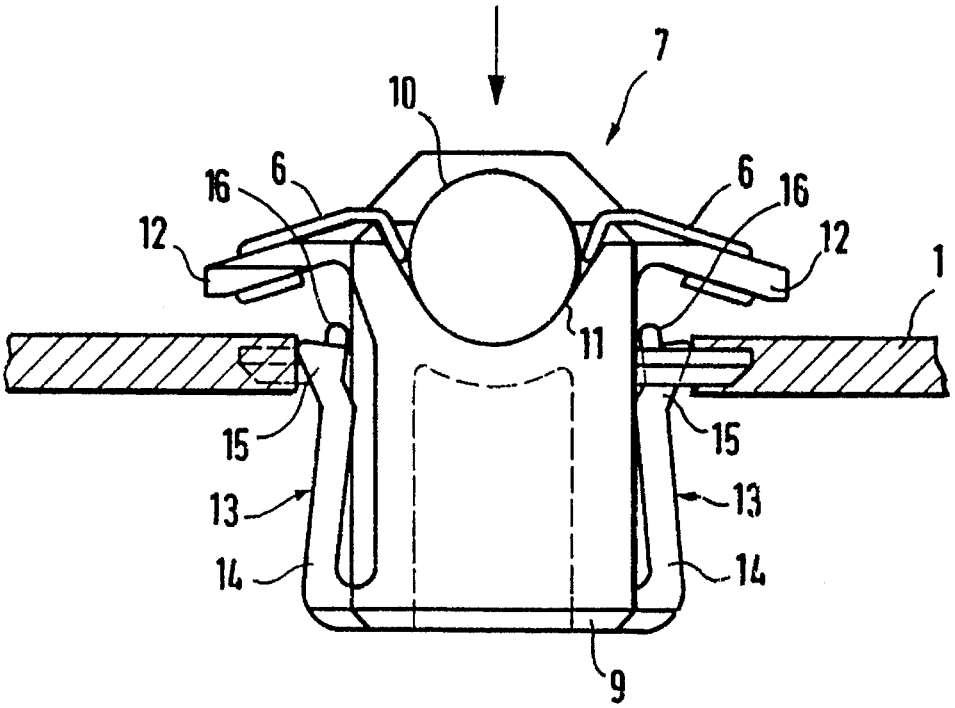
FIG. 2 shows a socket provided with a lamp and inserted partially into the opening of FIG. 1.

FIG. 2 shows the inventive socket 7, which has an essentially hollow cylindrical socket body 9, the upper region of which is constructed as a reflector to accommodate the small incandescent lamp 10 disposed in a prone position in the embodiment shown and, due to the trough-shaped recess 11, can, for example, have a mirror coating to increase the degree of reflection or consist of a white material, particularly of a plastic. The lamp wires 6 are guided at the contact arms 12, disposed at the socket body 9, in such a manner that, in the inserted state of the socket 7, they lie on the contact surfaces 5. The manner, in which the lamp wires 6 are guided or fastened at the contact arms 12, will be described later. Two diametrically opposite locking arms 13 are mounted flexibly on the underside of the socket body 9. In the present case, said locking arms 13 are formed by legs 14 which, as a result of being bent essentially by 180°, extend essentially parallel to the wall of the socket. The locking arms can, however, also be formed by simple incisions in the cylinder wall. At the upper side ends of the locking arms 13, projections 15 are formed which, in the inserted state (see FIG. 3), engage the underside of the printed circuit board 1. Moreover, to limit the lateral spring motion of the locking arms 13 in the region of the projections 15, further, bead-like projections 16 are formed. In the contact position, said beads 16 lie against the inner side of the constricted regions 4 of the openings 2 and thus prevent further give of the locking arms 13.

Figure 3:
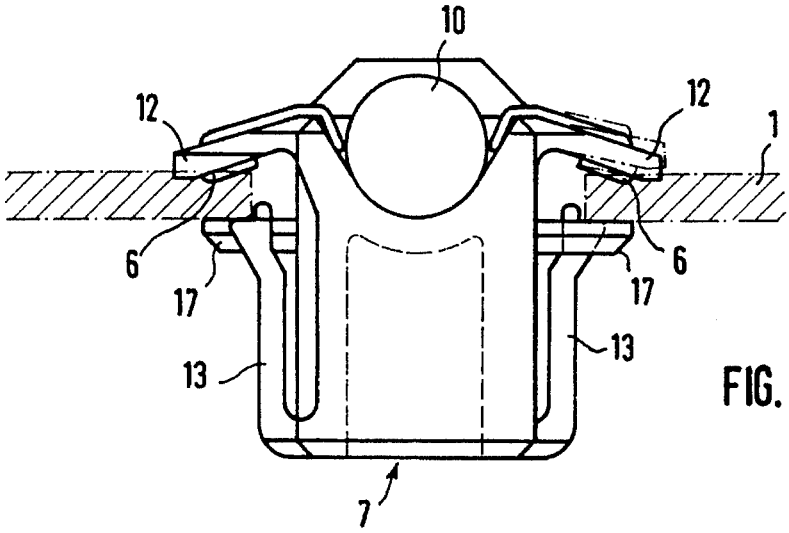
FIG. 3 shows the socket of FIG. 2 inserted completely into the opening.

FIG. 3 now shows the socket 7 of FIG. 2 in its inserted, contact position. The locking arms 13 grip in a known manner behind the printed circuit board and are supported against the contact arms 12, which are supported elastically at the socket body 9, so that the socket 7 is fixed reliably in the opening 2. As can be inferred from FIG. 3, the lamp-connection wires 6 then lie on the printed circuit board 1 and, with that, on the contact surfaces 5.

Figure 4:
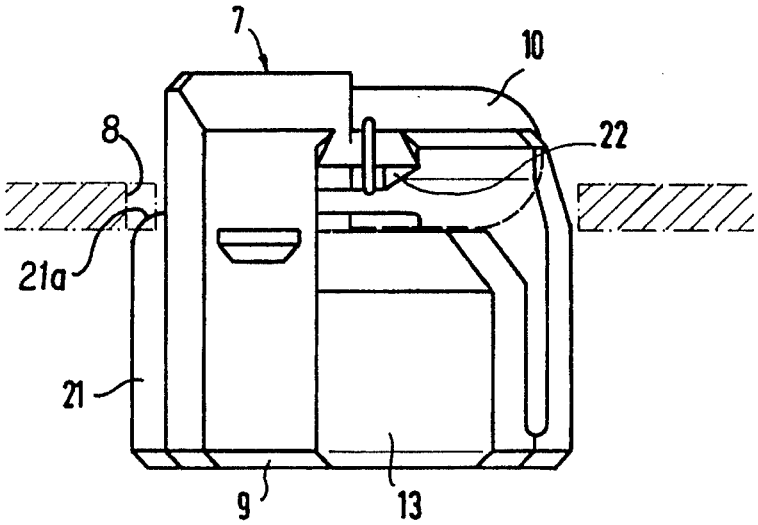
FIG. 4 shows a view of the socket of FIG. 3 turned through an angle of 90°.
Figure 5:
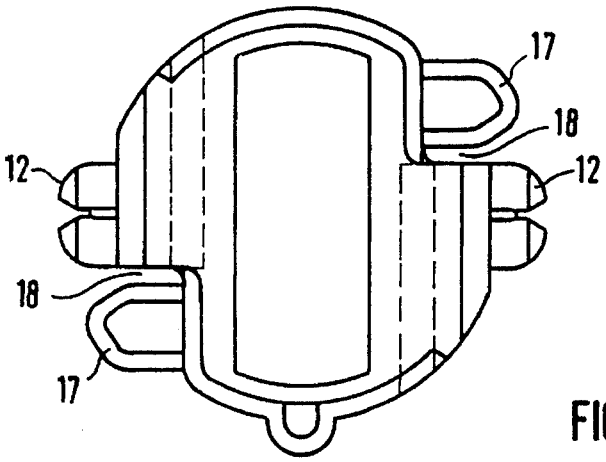
FIG. 5 shows a plan view of the socket from below.

Moreover, the locking nose 21, formed at the socket body 9, can be seen in the view, which is shown in FIG. 4 and rotated through 90°. In the contact position shown, the locking nose 21 then engages the bulge 8 of opening 2 and thus serves as installation coding and security against turning. Furthermore, the insertion incline 22, which is provided at each contact arm 12 and serves to fix the correct direction of screwing when lamps are exchanged, is shown. Moreover, it can be seen from FIG. 3 that two tabs 17, projecting perpendicularly to the body 9 of the socket, are constructed at the socket body 9. As can be seen particularly in FIG. 5, said tabs 17 are disposed diametrically opposite to one another and are limiting tabs for the insertion movement, which takes place within the scope of the turning or screwing mechanism, when the socket 7 is to be inserted or removed into or from the printed circuit board from the other side, limiting the insertion movement before the turning. These tabs 17, which must be passed through the opening 2 of the printed circuit board 1 for the snapping-in mode shown in FIGS. 1 to 4, are shifted to the inside into the indentations 18 formed at the socket 7. Moreover, they are disposed offset to the contact arms 12, so that, as can be seen particularly in the plan view of FIG. 6, they are passed through the enlargements 3 of the opening 2 during the snapping-in process and, after locking has been accomplished, run partially congruently to these enlargements 3 and thus reduce the passage of light through these. The actual function of the tabs 17 will be dealt with in greater detail later in conjunction with FIG. 8.

Figure 6:
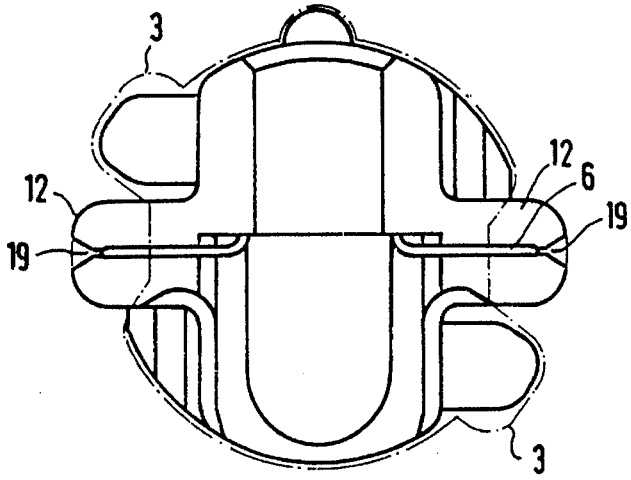
FIG. 6 shows a plan view of the socket of FIG. 3.

FIG. 6 furthermore shows the already addressed specific construction of the contact arms 12 for the purpose of fastening the lamp-connection wires 6. The end region of each contact arm 12 has a recess 19 in the shape of a groove increasing in width to the outside, the diameter at the base of which is somewhat less than the diameter of the lamp wire 6, so that the latter is held by being jammed. The lamp-connection wire 6 is passed through two essentially 90° bends from the upper side through the groove 19 to the underside and, with that, to the contacting site, as can be seen in the preceding Figures.

Figure 7:
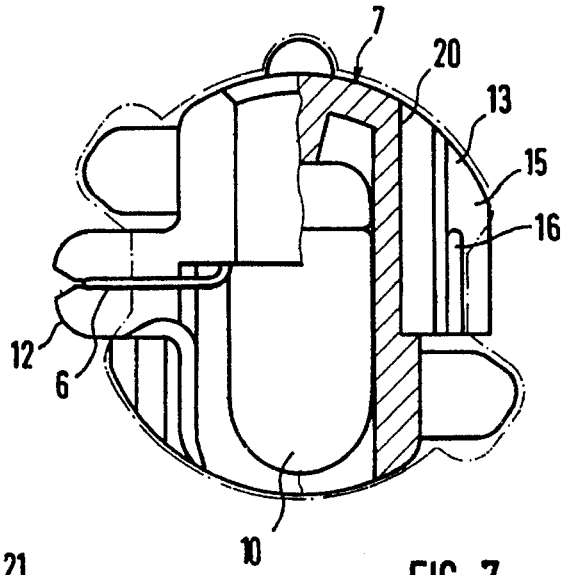
FIG. 7 shows a plan view of FIG. 6 partially in section.

Further details with respect to the construction, especially in the region of the locking arms 13, are shown in FIG. 7 which shows a partial section through the socket 7. In order to assure adequate springiness of the locking arms 13, the socket 7 has a recess 20 in the wall region running parallel to the locking arm 13 so that the latter is at a sufficient distance from the wall of the socket to assure an adequate spring excursion.

Figure 8:
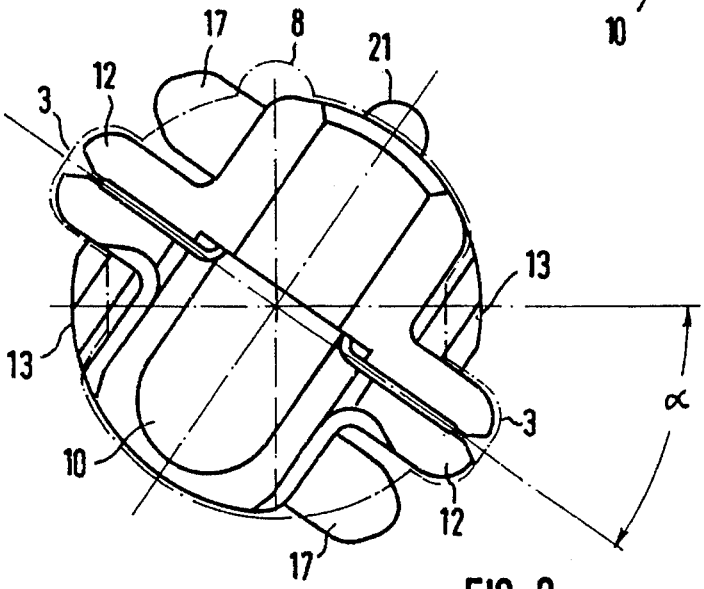
FIG. 8 shows a plan view of the socket of FIG. 6 in the insertion or removal position turned by the angle of twist.

The function of the turning mechanism and the tabs 17 becomes clear from FIG. 8. The starting point is the contact position shown in FIG. 6, which was attained by snapping in at the upper side of the printed circuit board. To remove the socket 7 on the other side of the printed circuit board, the socket 7 is twisted out of its contact position, for which initially the tabs 17, passed through the enlargements 3, lie congruently with these, by a predetermined angle $\alpha$, which is 35° in the embodiment shown, to such an extent, that the contact arms 12 run congruently with the enlargements 3, yet on the upper side of the printed circuit board. To remove it, the socket 7 is then simply pulled out of the opening 2, the contact arms 12 being passed through the enlargements 3. The reverse procedure is followed in order to insert a new socket 7. The socket 7 is pushed so far into the opening 2 while, at the same time, the contact arms 12 are passed through the enlargements, until the tabs 17 lie against the underside of the printed circuit board 1 and limit the insertion movement. Only then is the socket turned through the angle $\alpha$ in order to bring it into the contact position, the contact position being reached by locking the locking nose 21 into the bulge 8. The tabs 17 once again then lie essentially congruently with the enlargements 3. Aside from such a removal from the side opposite to the insertion side, removal of the socket 7 from the snapping-in side, however, is also possible. For the latter removal, the locking arms 13 must merely be impressed out of their locking position (see FIG. 3) inwardly into the recess 20, after which the socket 7 can be removed with passage of the tabs 17 through the enlargement 3.

The socket 7 is fixed in its operative position by means of the locking nose 21, as shown in FIGS. 6 and 7 wherein the locking nose 21 engages the semicircular recess 8. As can be seen from FIG. 4, the upper region of the locking nose 21 itself, which engages the recess 8, is round and hemispherical as indicated at 21*a* in FIG. 4. In the operative position of the socket as shown in FIG. 4, the upper, rounded region 21*a* of the locking nose 21 goes only a little way into the recess 8 but far enough, however to fix the socket 7. Fixation against inadvertent twisting is accomplished owing to the fact that when the socket 7 is twisted, the upper, rounded region 21*a* of the locking nose 21 comes up against the edges of the recess 8. Thus the socket 7 can not therefore be twisted accidentally or inadvertently. When the socket 7 is to be removed, it is rotated with minimal effort out of the position shown in FIG. 7 into the position shown in FIG. 8. As a result of the spherical shape of the upper region 21*a* of the locking nose 21, the upper region 21*a*, as a result of the twisting, comes up against the edges of the recess 8. Upon further twisting, the upper region 21*a* of the locking nose 21 slips under the printed circuit board 1, so that it can be released from its engagement in the recess 8. Once the locking nose 21 has been rotated out of the recess 8, it can easily be turned further. Because of the rounded construction, the locking nose 21 is not arrested in or squeezed into the recess 8; rather, it can be unscrewed out of its engagement position with minimal axial shifting of the socket 7 by twisting, which requires only a minimal expenditure of force by the user. The minimal axial shifting results from the elasticity of the locking nose 21 and its rounded regular 21*a* and the elasticity of the arms 12.

For inserting the socket, the process is the reverse. Starting from the position shown in FIG. 8, the socket 7 is introduced into the printed circuit board opening, until the tabs 17 and, with that also the upper region 21*a* of the locking nose 21, lie against the underside of the printed circuit board. The socket 7 is subsequently twisted, the locking nose 21 being pushed along the underside of the printed circuit board until it reaches the recess 8, into which it then slides and thus arrives at the fixed end position shown in FIG. 7.

Figure 9:
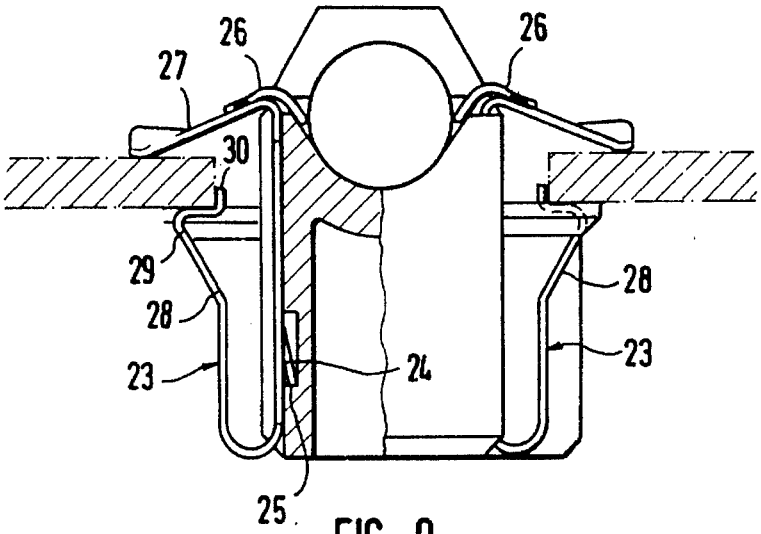
FIG. 9 shows a partially sectional view of a socket of a second embodiment inserted into the opening in the printed circuit board.
Figure 10:
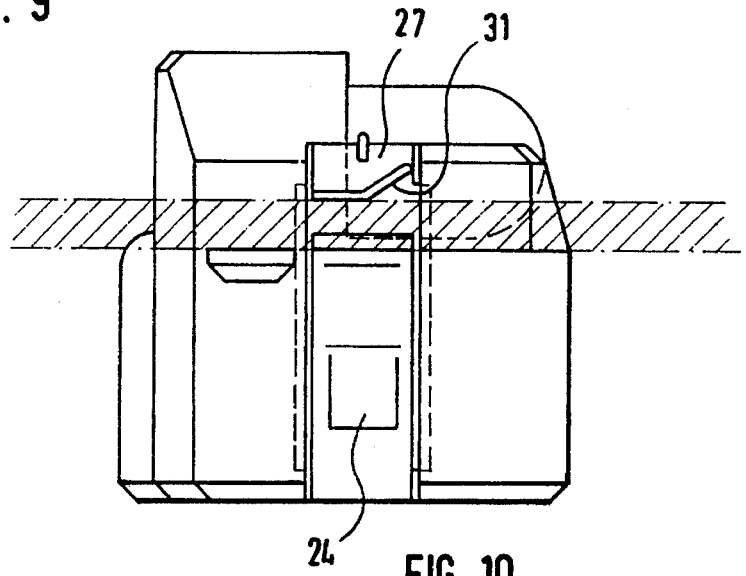
FIG. 10 shows the socket of FIG. 9 in a view turned through an angle of 90°.
Figure 11:
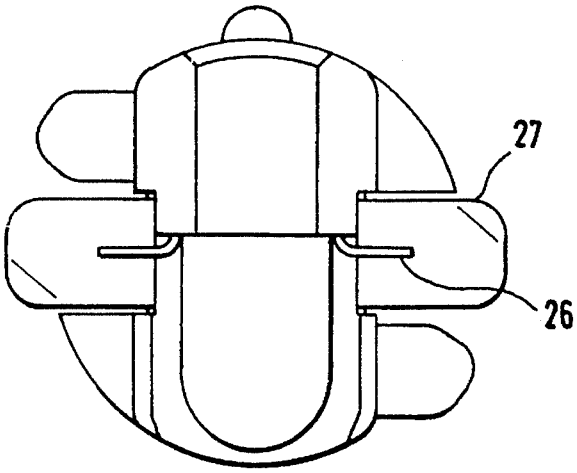
FIG. 11 shows a plan view of the socket of FIG. 9.

FIGS. 9 to 11 show a further embodiment of the inventive socket in detail. In this case, the contact arm and the locking arm, which are required on one socket side, are formed by a metal spring 23 constructed in one piece. The metal spring 23 is fastened by means of a bracket 24 in recess 25 formed at the socket body. With this one-piece contact spring 23, it is thus possible to contact strip conductors, which run on the upper side and/or on the underside, either on the upper side, the underside or on both sides, so that this embodiment can be used for printed circuit boards of any type, since contacting is always ensured. The lamp-connection wires 26, which are somewhat shorter here, are welded or soldered to the contact spring 23 in the region of the contact arm 27. The resiliency of the locking arm 28 is produced by appropriately bending the contact spring in the lower region so that, on the one hand, a reliable and secure locking is ensured within the opening and, on the other, a sufficiently large contact area of the locking arm 28 engaging the underside of the printed circuit board is present. The end region of the locking arm 28 is bent as a locking and contact projection 29, a section 30, limiting the spring deflection, adjoining the projection 29. The side view of FIG. 10 clearly shows the bracket 24, which serves for the fastening. The bracket 24 is formed by incisions and bending and inserted into the appropriate recess 25 and, optionally, glued. Moreover, FIG. 10 also shows the insertion incline 31 formed at the contact arm 27.

Finally, FIG. 11 shows a plan view of the socket of the second embodiment, which clearly shows the construction of the contact arms 27. In contrast to the contact arms of the first embodiment, these have no grooves at the ends and, instead, are closed, because, for making contact, the lamp-connection wires 26 do not have to be passed downwards and need only be fastened to the upper side of the contact arms 27, since the actual contacting is accomplished by the metal contact arms 27.

What I claim is:

1. A socket for an incandescent lamp in which the socket is detachably mounted in an opening of a printed circuit board comprising:

a socket having an incandescent lamp;

first mounting means on said socket enabling mounting and removal of said socket from said circuit board opening from one side of said circuit board;

said socket comprising a housing, said first mounting means comprising locking arms flexibly disposed on said housing for movement between an engaging position and a retracted position, said locking arms contacting said circuit board when in said engaging position, said locking arms when in said retracted position enabling said socket to pass through said opening;

second mounting means on said socket enabling mounting and removal of the socket from said circuit board opening from the other side of said circuit board;

said second mounting means comprising rotative support means supporting said socket for rotative movement between an operative rotative position and a displaced rotative position, said second mounting means being operable to enable rotation of said socket from said operative rotative position to said displaced rotative position and to thereafter enable removal of said socket from said other side of said circuit board when in said displaced rotative position;

said second mounting means being operable to effect removal of said socket from said other side of said circuit board which was initially mounted from said one side of said circuit board by said first mounting means.

2. A socket according to claim 1 wherein said first mounting means is operable to effect removal of said socket from said one side of said circuit board which was initially mounted from said other side of said circuit board by said second mounting means.

3. A socket according to claim 1 wherein said second mounting means is operable to enable insertion of said socket from said other side of said circuit board into said circuit board opening when said socket is in said displaced rotative position and to thereafter enable rotation of said socket from said displaced rotative position to said operative rotative position.

4. A socket according to claim 1 wherein said circuit board has contact areas, said socket having contact means, said contact means contacting said contact areas when said socket is in said operative rotative position.

5. A socket according to claim 4 wherein said contact means are disposed in superimposed spaced relationship with said locking arms, said circuit board being disposed in the space between said contact means and said locking arms when said socket is in said operative rotative position.

6. A socket according to claim 5 wherein said second mounting means comprises tabs on said housing, said tabs being displaced from superimposed relationship with said contact means, said circuit board being disposed between said contact means and said tabs when said socket is in said displaced rotative position.

7. A socket according to claim 6 wherein there are two of said tabs diametrically opposed to one another, said tabs engaging said other side of said circuit board when said socket is inserted into said opening from said other side of said circuit board while in said displaced rotative position such that said tabs serve as stops to limit the extent of insertion of said socket into said opening, said circuit board opening having diametrically opposed enlarged sections, said tabs being aligned with said enlarged sections when said socket is in said operative rotative position such that said socket can be removed from said opening from said one side of said circuit board when said socket is in said operative rotative position.

8. A socket according to claim 7 wherein said contact means comprises two diametrically opposed contact arms, said contact arms being aligned with said enlarged sections when said socket is in said displaced rotative position such that said socket can be withdrawn from said opening from said other side of said circuit board when said socket is in said displaced rotative position.

9. A socket according to claim 1 wherein said socket housing has a generally hollow cylindrical configuration, said locking arms having one end part integrally joined to said socket housing and another elongated part spaced from said socket housing, said socket housing having a side wall, said elongated part of said locking arms being generally parallel to said side wall.

10. A socket according to claim 9 wherein said elongated parts of said locking arms are designated as flexible locking legs which are generally parallel to the axis of said socket opening, said flexible locking legs having engaging means, said flexible locking legs having an engageable position in which said engaging means engages said other side of said circuit board when said socket is in said operative rotative position, said flexible locking legs having a disengaged position in which said flexible locking legs are disengaged from said other side of said circuit board so that said socket can be removed from said opening from said one side of said circuit board.

11. A socket according to claim 10 wherein said opening in said circuit board has an inside wall, said engaging means having one part engaging said inside wall when said flexible locking legs are in said engageable position.

12. A socket according to claim 1 wherein said locking arms are metal locking arms which are mounted on said socket housing.

13. A socket according to claim 12 wherein said contact means comprises metal contact elements mounted on said socket housing.

14. A socket according to claim 13 wherein one of said metal locking arms is connected to one of said metal contact elements, said one metal locking arm having an engaging part engaging said other side of said circuit board when said socket is in said operative rotative position, said one metal contact element having an engaging part engaging said one side of said circuit board when said socket is in said operative rotative position.

15. A socket according to claim 14 wherein said one metal locking arm and said one metal contact element are formed of one piece of metal, said socket housing having a recess for mounting said one piece of metal on said socket housing.

16. A socket according to claim 6 wherein said socket housing has indentations, said tabs extending into said indentations.

17. A socket according to claim 1 wherein the amount of rotation of said socket between said operative rotative position and said displaced rotative position is within the range of 30° to 40°.

18. A socket according to claim 17 wherein said amount of rotation is about 35°.

19. A socket according to claim 1 wherein said socket opening has a groove, said socket having a projecting locking nose which is received in said groove when said socket is in said operative rotative position.

20. A socket according to claim 4 wherein said contact means comprises contact arms having a jamming groove, said lamp having lead wires, said contact arms having a natural state in which the width of said jamming groove is narrower than the diameter of said lead wire, said lead wire being forced into said jamming groove to biasingly increase the width of said groove such that the lead wire is thereby biasingly retained in said jamming groove.

21. A socket according to claim 4 wherein said contact means are provided with an insertion incline.

22. A socket according to claim 1 wherein said housing has a receiving wall for said lamp, said receiving wall being formed as a reflector.

23. A socket according to claim 1 wherein said lamp has a longitudinal lamp axis, said opening in said circuit board having an opening longitudinal axis, said lamp longitudinal axis being perpendicular to said opening perpendicular axis when said socket is in said operative rotative position.

24. A socket according to claim 1 wherein said socket is made from one piece of material.

25. A socket according to claim 23 wherein said material is plastic.

* * * * *